US008196794B2

(12) United States Patent
Kernosky

(10) Patent No.: US 8,196,794 B2
(45) Date of Patent: Jun. 12, 2012

(54) RIVETING SYSTEM AND MULTI-PIECE SELF PIERCE DIE FOR IMPROVED DIE LIFE

(75) Inventor: Stephen Kernosky, Livonia, MI (US)

(73) Assignee: Ford Motor Company, Dearborn, MI (US)

( * ) Notice: Subject to any disclaimer, the term of this patent is extended or adjusted under 35 U.S.C. 154(b) by 1101 days.

(21) Appl. No.: 11/161,462

(22) Filed: Aug. 4, 2005

(65) Prior Publication Data

US 2006/0042349 A1 Mar. 2, 2006

Related U.S. Application Data

(60) Provisional application No. 60/603,837, filed on Aug. 24, 2004.

(51) Int. Cl.
*B21J 15/00* (2006.01)

(52) U.S. Cl. ..... 227/154; 29/243.53; 29/798

(58) Field of Classification Search ..... 29/243.53, 29/243.54, 798, 432.2, 524.1, 525.06, 154, 29/391.2, 391.4; 227/154; 72/391.2, 391.4
See application file for complete search history.

(56) References Cited

U.S. PATENT DOCUMENTS

| | | | | |
|---|---|---|---|---|
| 2,465,534 | A * | 3/1949 | Havener | 29/464 |
| 3,554,427 | A * | 1/1971 | Steggles | 227/61 |
| 3,685,623 | A * | 8/1972 | Bradshaw | 192/107 R |
| 3,977,229 | A * | 8/1976 | Alvi et al. | 29/243.521 |
| 4,106,180 | A | 8/1978 | Fuhrmeister | |
| 4,133,096 | A | 1/1979 | Falcioni | |
| 4,136,417 | A * | 1/1979 | Dahmen et al. | 470/31 |
| 4,192,058 | A * | 3/1980 | Falcioni | 29/525.06 |
| 4,810,143 | A | 3/1989 | Muller | |
| 5,140,735 | A * | 8/1992 | Ladouceur | 29/243.522 |
| 5,179,852 | A * | 1/1993 | Lovejoy et al. | 72/53 |
| 5,752,305 | A * | 5/1998 | Cotterill et al. | 29/432.2 |
| 5,810,530 | A * | 9/1998 | Travis | 411/34 |
| 5,884,386 | A | 3/1999 | Blacket et al. | |
| 6,325,584 | B1 | 12/2001 | Marko et al. | |
| 6,405,420 | B1 | 6/2002 | Donhauser et al. | |
| 6,417,490 | B1 | 7/2002 | Liebrecht et al. | |
| 6,663,329 | B2 * | 12/2003 | Singh et al. | 411/501 |
| 6,883,223 | B2 * | 4/2005 | Edwards | 29/525.06 |
| 2003/0046804 | A1 | 3/2003 | Donovan | |
| 2003/0101566 | A1 * | 6/2003 | Ladouceur | 29/432.2 |
| 2004/0060958 | A1 | 4/2004 | Kondo | |
| 2004/0261259 | A1 * | 12/2004 | Naito | 29/798 |
| 2005/0019137 | A1 * | 1/2005 | Iwatsuki et al. | 411/501 |
| 2005/0229375 | A1 * | 10/2005 | Naitoh | 29/432.2 |
| 2006/0016056 | A1 * | 1/2006 | Kato | 29/34 B |

FOREIGN PATENT DOCUMENTS

| | | |
|---|---|---|
| GB | 2 068 493 A | 8/1981 |
| GB | 2 141 369 A | 12/1984 |
| GB | 2 314 794 A | 1/1998 |

* cited by examiner

*Primary Examiner* — Lindsay Low
(74) *Attorney, Agent, or Firm* — Raymond Coopiellie Brooks Kushman P.C.

(57) ABSTRACT

A multi-piece die and system for driving a self pierce rivet into a plurality of workpieces. The die includes an anvil and a collar affixed to the anvil. The anvil and collar cooperate to reduce stresses to reduce breaking of the die.

20 Claims, 2 Drawing Sheets

RIVETING SYSTEM AND MULTI-PIECE SELF PIERCE DIE FOR IMPROVED DIE LIFE

CROSS-REFERENCE TO RELATED APPLICATIONS

This application claims the benefit of U.S. provisional application Ser. No. 60/603,837 filed Aug. 24, 2004.

BACKGROUND OF THE INVENTION

1. Field of the Invention

The present invention relates to a die for self pierce riveting and a system for driving a self pierce rivet into a plurality of workpieces.

2. Background Art

Self pierce rivets may be used to assemble a plurality of workpieces together. Self pierce rivets are commonly upset using a die assembly. Previous die assemblies utilized a one piece forming die. Under some conditions one piece forming dies are not durable and may easily crack and break due to the high forces involved in self pierce riveting. In addition, the Applicant of the present invention has discovered that one piece dies may fail due to the high localized stresses associated with the use of a one piece die design, the condition of machined die surfaces, and tooling marks (e.g., scratches) that may cause stress risers and subsequently lead to premature die breakage.

SUMMARY OF THE INVENTION

In at least one embodiment of the present invention, a die for shaping a self pierce rivet is provided. The die includes an anvil and a collar. The anvil includes a first portion, a flange portion, and a second portion. The first portion has a perimeter surface. The flange portion extends around the perimeter surface and includes upper and lower surfaces. The second portion is coaxially disposed with the first portion and extends away from the upper surface. The collar is affixed to the anvil and includes an inner surface that contacts the perimeter surface and an end surface that mates with the upper surface of the flange portion. The anvil and collar cooperate to reduce stresses to reduce breaking of the die.

In at least one other embodiment of the present invention, a die for shaping a self pierce rivet is provided. The die includes an anvil and a collar. The anvil has an end surface and a first perimeter surface disposed about a center axis. The collar has an inner surface affixed to the perimeter surface. The anvil and collar cooperate to reduce stresses to inhibit breaking of the die.

In at least one other embodiment of the present invention, a system for driving a self pierce rivet into a plurality of workpieces is provided. The system includes a fixture, a first die, a second die, and an actuator. The fixture includes an aperture. The first die includes an anvil and a collar. The anvil includes a first portion disposed in the aperture, a flange portion, and a second portion. The flange portion extends around the perimeter of the first portion and includes a lower surface that contacts the fixture and an upper surface disposed opposite the first surface. The second portion is coaxially with the first portion and extends away from the upper surface. The collar is affixed to the anvil. The collar has an inner surface that contacts a perimeter of the second portion and a lower surface that contacts the upper surface. The actuator is disposed proximate the fixture and is configured to move the second die in an axial direction between a retracted position and an advanced position to axially drive the self pierce rivet. The anvil and collar cooperate to reduce stresses and inhibit breaking of the first die.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
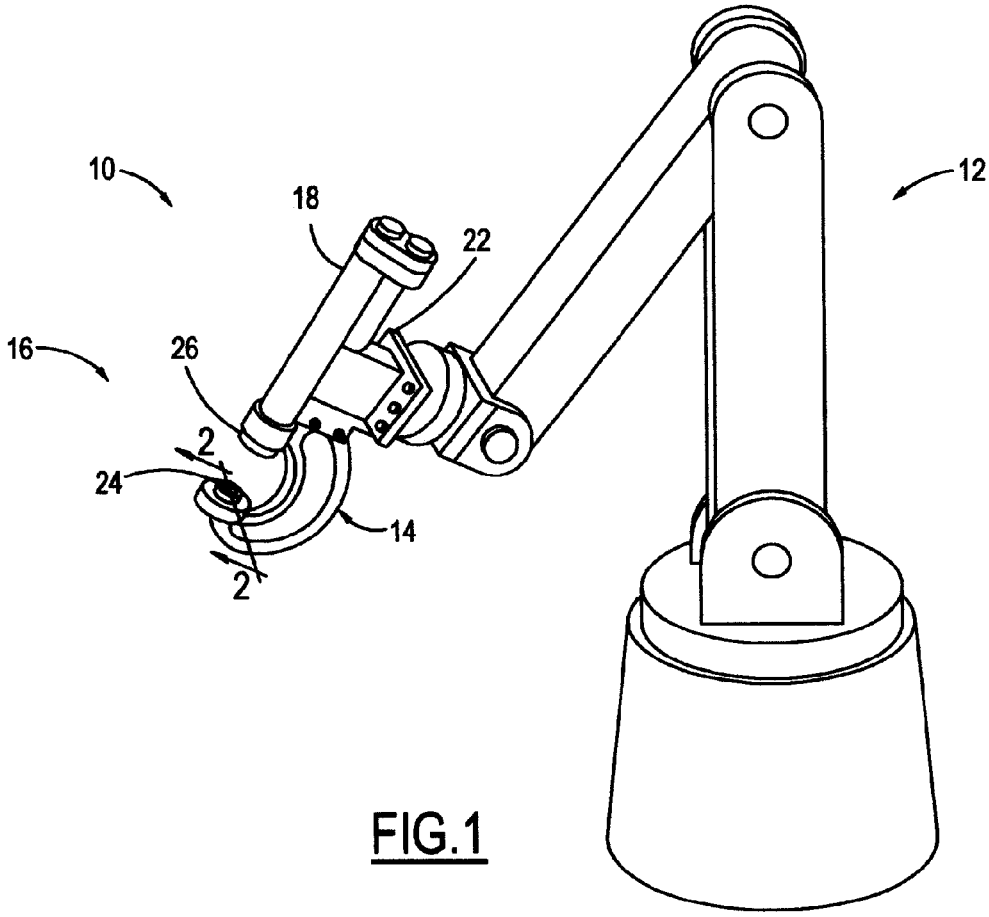
FIG. 1 is a schematic of a system for driving a self pierce rivet.

Referring to FIG. 1, a system 10 for driving a self pierce rivet into a plurality of workpieces is shown. The system 10 may include a manipulator 12, a fixture 14, a die assembly 16, and an actuator 18.

The manipulator 12 may have any suitable configuration. In the embodiment shown, the manipulator 12 is configured as a robot configured to move about one or more axes. The manipulator 12 permits the fixture 14 and die assembly 16 to be moved to various positions to facilitate riveting of a plurality of workpieces. Alternatively, the manipulator 12 may be omitted in various embodiments of the present invention.

Figure 2:
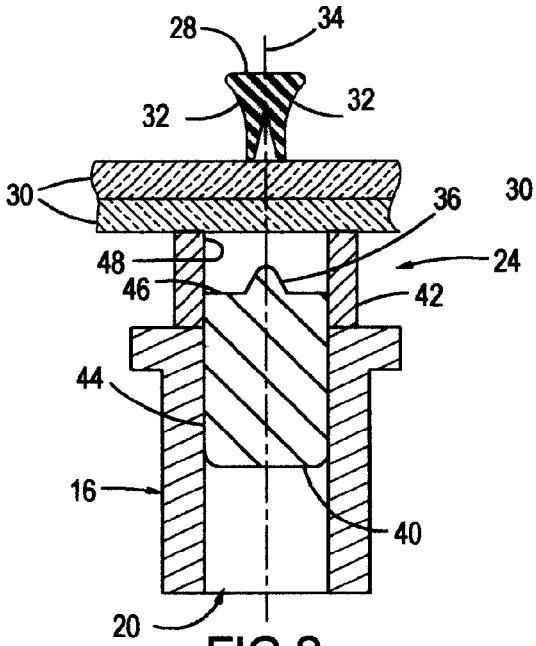
FIG. 2 is a magnified section view of a portion of the system taken along line 2-2 of FIG. 1 illustrating a self pierce rivet prior to upsetting.

Referring to FIGS. 1 and 2, an exemplary embodiment of the fixture 14 is shown. The fixture 14 may be configured to be mounted on the manipulator 12. Moreover, the fixture 14 may be adapted to receive the die assembly 16 and/or the actuator 18. The fixture 14 may have any suitable configuration. In the embodiment shown, the fixture 14 is generally C-shaped and includes an aperture 20 for receiving a portion of the die assembly 16 and a mounting portion 22 for receiving the actuator 18.

Figure 3:
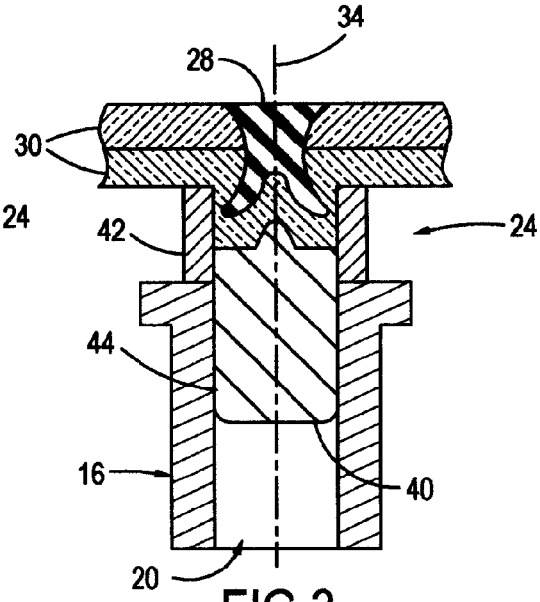
FIG. 3 is a magnified section view of the portion of the system shown in FIG. 2 illustrating upsetting of the self pierce rivet.

Referring to FIGS. 1-3, an embodiment of the die assembly 16 is shown. The die assembly 16 may include a first die 24 and a punch or second die 26. The first and second dies 24,26 cooperate to upset a self pierce rivet 28. More specifically, the second die 26 is adapted to exert force against the self pierce rivet 28 to drive the self pierce rivet 28 into a plurality of workpieces 30 while the first die 24 is adapted to help form the self pierce rivet 28.

As shown in FIGS. 2 and 3, the self pierce rivet 28 includes a plurality of protrusions 32 that extend away from the head of the self pierce rivet 28. The protrusions 32 pierce through some, but not all of the workpieces 30 and are deformed to help secure the self pierce rivet 28 and workpieces 30 together. More specifically, the protrusions 32 are deformed outwardly by the action of the die assembly 16, but do not penetrate completely through the workpiece disposed adjacent to the first die 24 when the self pierce rivet 28 is properly upset.

The first die 24 may have any suitable configuration. Various exemplary embodiments are shown in FIGS. 3 and 4A-4M and discussed in more detail below. The second die 26 may also have any suitable configuration and may include a generally planar surface that engages the self pierce rivet 28.

The actuator 18 may be configured to receive the second die 26 and provide force for upsetting the self pierce rivet 28. More specifically, the actuator 18 may be configured to move between a retracted position in which the first and second dies 24,26 are spaced apart from each other and an advanced position in which the first and second dies 24,26 are positioned closer together. The actuator 18 may be of any suitable type, such as a hydraulic, pneumatic, electric, mechanical, or other type of actuator.

Referring to FIGS. 2, 3, and 4A-4M, various embodiments of the first die are shown. For convenience, common reference numbers are used to designate identical or similar features or components when possible. In each embodiment, the first die includes multiple pieces. In a two piece embodiment, the first die may include an anvil and a collar. In a three piece embodiment, the first die may include an anvil, a collar, and a flange. In these embodiments the anvil and collar may be coaxially disposed about a center axis 34 as shown in FIGS. 2-3. Moreover, in each of these embodiments, the anvil may include an end surface having an optional protrusion or nub 36 that helps direct the protrusions toward the collar during upsetting of the self pierce rivet 28. Moreover, in each embodiment the end surface may be disposed generally perpendicularly to an adjacent surface of the collar so that the self pierce rivet is properly upset.

The first die may be made of any suitable material or materials. For example, the anvil may be made of a material with good wear resistance and compressive strength, such as an A8 or M2 grade steel, while the collar made be made of a material that having good fatigue resistance, such as an H13 VAR (vacuum arc remelted) steel. In addition, the anvil and collar may each have different hardness to accommodate different types and/or magnitudes of stress. In at least one embodiment, the hardness of the anvil may be greater than the hardness of the collar to accommodate the compressive forces that occur when the self pierce rivet 28 is upset. For instance, the anvil and collar may be configured with hardness of $R_C$ 60-64 and $R_C$ 56-61, respectively. Of course, larger or smaller hardness ranges that may or may not overlap may also be provided in various embodiments of the present invention.

Referring to FIGS. 2-3, an embodiment of the first die 24 is shown that includes an anvil 40 and a collar 42. The anvil 40 is configured to be received in the aperture 20 of the fixture 14. The anvil 40 includes an outside or perimeter surface 44 and an end portion 46 that extends from the aperture 20. The collar 42 defines a hole and includes an interior surface 48 that is attached to the portion of the perimeter surface associated with the end portion 46.

Figure 4A:
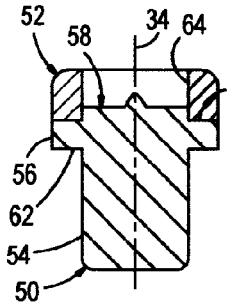
FIGS. 4A-4M illustrate various embodiments of a multi-piece die.

Referring to FIG. 4A, another embodiment of the first die is shown that includes an anvil 50 and a collar 52. The anvil 50 includes a first portion 54 that may be configured to be received in the aperture 20, a flange portion 56, and a second portion 58. The flange portion 56 includes an upper surface 60 and a lower surface 62 disposed opposite and generally parallel to the upper surface 60. The lower surface 62 may contact the fixture 14 when the first portion 54 is disposed in the aperture 20. The second portion 58 may extend from the upper surface 60 and may be coaxially disposed with the first portion 54. The collar 52 may include an interior surface 64 disposed adjacent to the perimeter of the second portion 58 and an end or mating surface 66 disposed adjacent to the upper surface 60.

Figure 4B:
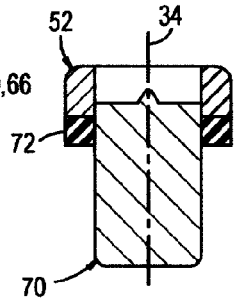

Referring to FIG. 4B, a three piece embodiment of the first die is shown that includes a collar 52, an anvil 70, and a flange portion 72. The flange portion 72 is disposed around and attached to the perimeter surface of the anvil 70. The flange portion 72 may be attached in any suitable manner as will be described in more detail below.

Figure 4C:
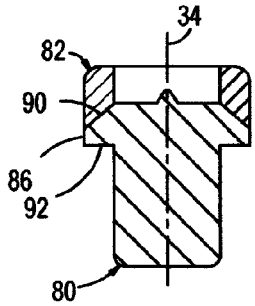
Figure 4D:
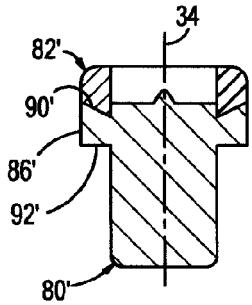

Referring to FIGS. 4C-4D, two piece embodiments are shown in which the upper and lower surfaces of the flange portion are disposed at an angle relative to each other. In FIG. 4C, the first die includes an anvil 80 and a collar 82. The anvil 80 has a flange portion 86 that includes an upper surface 90 that is angled toward the lower surface 92 in a direction extending away from a center axis 34. In FIG. 4D, the first die also includes an anvil 80' and a collar 82'. The anvil 80' has a flange portion 86' that includes an upper surface 90' that is angled toward the lower surface 92' in a direction extending toward the center axis 34. In these embodiments, the collar 82,82' includes a mating surface 96,96' that mates with the upper surface 90,90'. These configurations help position the collar with respect to the anvil and may provide improved force distribution.

Figure 4E:
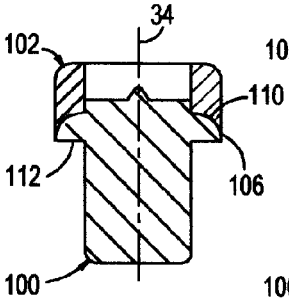
Figure 4F:
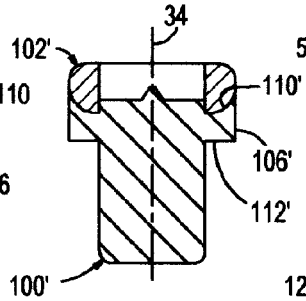

Referring to FIGS. 4E-4F, embodiments are shown in which the upper and lower surfaces of the flange portion are non-planar. In FIG. 4E, the first die includes an anvil 100 and a collar 102. The anvil 100 has a flange portion 106 that includes an upper surface 110 and a lower surface 112. The upper surface 110 is convex and slopes toward the lower surface 112 in a direction extending away from the center axis 34. In FIG. 4F, the first die also includes an anvil 100' and a collar 102'. The anvil 100' has a flange portion 106' that includes upper and lower surfaces 110',112'. The upper surface 110' is concave and slopes toward the lower surface 112' in a direction extending toward the center axis 34.

Figure 4G:
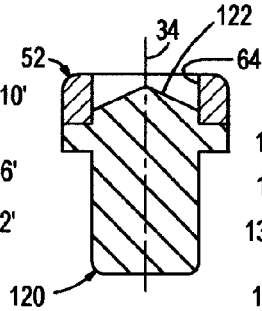

Referring to FIG. 4G, an embodiment similar to FIG. 4A is shown. In this embodiment, the anvil 120 has an end surface 122 having a generally conical configuration that intersects the interior surface 64 of the collar 52 at an angle. As such, this configuration helps direct the protrusions of the self pierce rivet 28 during upsetting and help distribute forces.

Figure 4H:
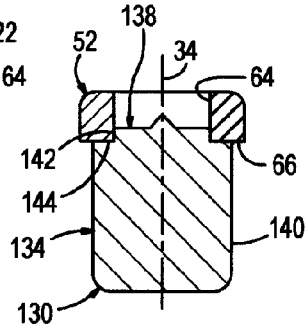

Referring to FIG. 4H, an embodiment is shown that includes an anvil 130 having first and second portions 134, 138. The first portion 134 includes a first perimeter surface 140. The second portion 138 includes a second perimeter surface 142. A step surface 144 extends between the first and second perimeter surfaces 140,142. The interior surface 64 and mating surface 66 of the collar 52 are disposed adjacent to the second perimeter surface 142 and step surface 144, respectively.

Referring to FIGS. 4I-4M, additional embodiments are shown that depict features that help facilitate assembly of the anvil and collar. Alternatively, the anvil and collar may be joined in other ways, such as with welding, an adhesive, an interference fit, and/or one or more fasteners.

Figure 4I:
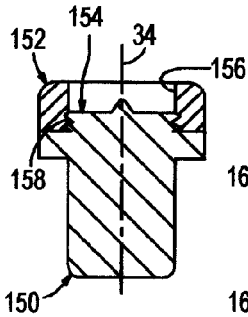
Figure 4J:
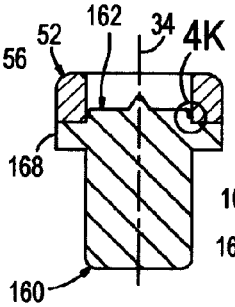

In FIG. 4I, at least a portion of the anvil 150 and collar 152 are provided with mating threads. In the embodiment shown, the second portion 154 of the anvil 150 and interior surface 156 of the collar 152 include mating threads 158 that permit easy assembly and disassembly of the anvil 150 and collar 152. As such, the anvil or collar may be replaced independently of each other, thereby reducing die assembly costs as compared to a one piece die design.

Figure 4K:
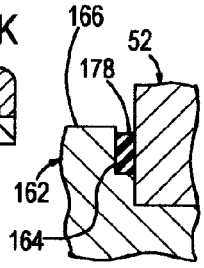
Figure 4L:
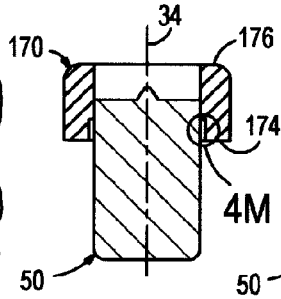
Figure 4M:
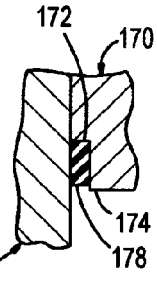

In FIGS. 4I and 4L, a groove is provided between the anvil and the collar. In FIG. 4I, the first die includes an anvil 160 and a collar 52. The anvil 160 includes a second portion 162 that includes a groove 164 that extends from the end surface 166 toward the flange portion 168. In FIG. 4L, the first die includes an anvil 50 and a collar 170. The collar 170 includes a groove 172 that extends from the lower surface 174 toward an upper surface 176. In each embodiment, the groove 164, 172 may extend partially or completely around the anvil or collar. The groove 164,172 may receive a solder material 178 for joining the anvil and the collar as is shown in FIGS. 4K and 4M, respectively.

The embodiments of the first die described above may be combined in any suitable manner. For example, the various anvil and collar attributes may be combined in multiple combinations. For example, the upper and mating surfaces in FIGS. 4C-4F may be incorporated with a three piece design. In addition, the mating threads shown n FIG. 4I or the groove and solder combinations of FIGS. 4I-4M may be integrated with the embodiments shown in FIGS. 4A-4H.

The embodiments of the first die described above may be fabricated in any suitable manner. For example, the anvil and/or collar may be formed in a desired shape, such as by casting or material removal. For instance, the anvil and or collar may be rough cut, finish cut, and hardened in any suitable order and with any suitable techniques to achieve desired geometry and material properties.

The multi-piece die of the present invention helps improve die durability as compared to a one piece design and may do so with little difference in die cost. Improved durability may also provide one or more of the following benefits. First, downtime is reduced, which helps improve process throughput and efficiency. Second, product quality and process reliability is improved, which may help reduce inspection costs and scrap.

A multi-piece die in accordance with one or more embodiments of the present invention may also expand the operating window of self pierce riveting. More specifically, additional joint configurations (sheet thickness, number of sheets, rivet length, etc.) are economically feasible with a multi-piece design that were not economically feasible with the best one piece design. In addition, a multi-piece design, which eliminates the continuous sharp inside corner of the one-piece design, is less sensitive to tooling marks that may impact die durability and product quality. Thus, a multi-piece design may improve die manufacturing robustness while easing the burden on die manufacture operations, such as machining, polishing, grinding, and inspection.

While the best mode for carrying out the invention has been described in detail, those familiar with the art to which this invention relates will recognize various alternative designs and embodiments for practicing the invention as defined by the following claims.

What is claimed is:

1. A system for driving a self pierce rivet into a plurality of workpieces, the system comprising:

a fixture having an aperture;

a first die comprising:

an anvil disposed along an axis, the anvil comprising:

a first portion disposed in the aperture, and a second portion coaxially disposed with the first portion and extending away from the aperture; and a collar disposed in direct contact with the anvil and disposed about the axis, wherein the collar and anvil are provided as separate pieces wherein a groove is defined in a surface of the anvil, the groove being disposed between the anvil and the collar to partially separate an interior surface of the collar from the anvil;

a second die; and an actuator disposed proximate the fixture, the actuator being configured to move the second die in an axial direction between a retracted position and an advanced position to axially drive the self pierce rivet such that the first die is spaced apart from the self pierce rivet;

wherein the anvil and collar cooperate to reduce stresses and inhibit breaking of the first die.

2. The system of claim 1 wherein the anvil has a greater hardness than the collar to inhibit breaking of the first die.

3. The system of claim 1 wherein the anvil is provided as a first steel alloy having a hardness of about 60 to 62 $R_C$ and the collar is provided as a second steel alloy having a hardness of about 56-58 $R_C$.

4. The system of claim 1 wherein the second portion further comprises an end surface and a nub that protrudes from the end surface.

5. The system of claim 1 wherein the first die further comprises a flange portion that extends around the second portion of the anvil, wherein the flange portion further comprises an upper surface and a lower surface disposed opposite the upper surface and adjacent to the fixture.

6. The system of claim 5 wherein the flange portion is provided as a separate component from the anvil.

7. The system of claim 5 wherein the upper and lower surfaces are substantially parallel.

8. The system of claim 5 wherein the second portion of the anvil further comprises an end surface and wherein the upper surface of the flange portion is disposed adjacent to and extends from the upper surface.

9. The system of claim 5 wherein the second portion of the anvil further comprises an end surface and wherein the upper surface of the flange portion is spaced apart from the end surface.

10. A system for driving a self pierce rivet into a plurality of workpieces, the system comprising:

a fixture having an aperture;

a first die comprising:

a one piece anvil disposed along an axis and including a first portion disposed in the aperture and a second portion disposed adjacent to the first portion and a nub extending from a surface of the second portion away from the aperture, and a cylindrical one piece collar disposed in continuous direct contact with the anvil; and a second die; and an actuator that moves at least one of the first and second dies between a retracted position and an advanced position to upset the self pierce rivet;

wherein the anvil has a greater hardness than the collar and the anvil and collar are provided as separate components to reduce stresses and inhibit breaking of the first die and wherein no voids are formed between the workpiece and the self pierce rivet after the self pierce rivet is upset.

11. The system of claim 10 wherein the first die further comprises a cylindrical flange portion that extends from the second portion of the anvil and concentrically about the axis, wherein the flange portion further comprises an upper surface and a lower surface disposed opposite the upper surface and adjacent to the fixture.

12. The system of claim 11 wherein the upper and lower surfaces are disposed in a nonparallel relationship to help position the collar.

13. The system of claim 11 wherein the upper surface is concave.

14. The system of claim 11 wherein the upper surface is convex.

15. The system of claim 11 wherein the upper surface is angled toward the lower surface in a direction extending toward the axis.

16. The system of claim 11 wherein the upper surface is angled toward the lower surface in a direction extending away from the axis.

17. A system for driving a self pierce rivet into a plurality of workpieces, the system comprising:

a fixture having an aperture;

a first die comprising:

a one piece anvil disposed along an axis and including a first portion disposed in the aperture and a second portion disposed adjacent to the first portion and extending away from the aperture, and a one piece collar disposed adjacent to the anvil and disposed about the axis;

a second die; and an actuator that moves at least one of the first and second dies between a retracted position and an advanced position to upset the self pierce rivet;

wherein the first die further comprises a groove disposed between the anvil and the collar that receives a solder material for joining the anvil and the collar.

18. The system of claim 17 wherein the collar and second portion of the anvil each include mating threads for removably coupling the collar to the anvil.

19. The system of claim 17 wherein the one piece collar is in direct contact with the anvil and the anvil has a greater hardness than the collar to inhibit breaking of the first die.

20. The system of claim 17 wherein the anvil further comprises first and second perimeter surfaces disposed concentrically about the axis such that the second perimeter surface has a smaller diameter than the first perimeter surface and a step surface extending from first perimeter surface to the second perimeter surface, wherein the lower surface of the collar contacts the step surface.

* * * * *